US011030932B1

(12) United States Patent
Fu et al.

(10) Patent No.: US 11,030,932 B1
(45) Date of Patent: Jun. 8, 2021

(54) DISPLAY PANEL AND DISPLAY DEVICE

(71) Applicant: Shenzhen China Star Optoelectronics Semiconductor Display Technology Co., Ltd., Guangdong (CN)

(72) Inventors: Min Fu, Guangdong (CN); Yongfeng Liu, Guangdong (CN)

(73) Assignee: Shenzhen China Star Optoelectronics Semiconductor Display Technology Co., Ltd., Guangdong (CN)

( * ) Notice: Subject to any disclaimer, the term of this patent is extended or adjusted under 35 U.S.C. 154(b) by 0 days.

(21) Appl. No.: 16/757,800

(22) PCT Filed: Mar. 23, 2020

(86) PCT No.: PCT/CN2020/080757
§ 371 (c)(1),
(2) Date: Apr. 21, 2020

(51) Int. Cl.
*G09G 3/20* (2006.01)

(52) U.S. Cl.
CPC ..... *G09G 3/20* (2013.01); *G09G 2300/0465* (2013.01); *G09G 2310/0267* (2013.01)

(58) Field of Classification Search
None
See application file for complete search history.

(56) References Cited

U.S. PATENT DOCUMENTS

2005/0142975 A1 6/2005 Lee
2015/0287158 A1* 10/2015 Cerny ..... G06T 15/10 345/553
2019/0164510 A1 5/2019 Fang et al.

FOREIGN PATENT DOCUMENTS

CN 107887418 A 4/2018
CN 107942565 A 4/2018
CN 108493227 A 9/2018
CN 109065592 A 12/2018
CN 109389909 A 2/2019

* cited by examiner

*Primary Examiner* — Chad M Dicke
(74) *Attorney, Agent, or Firm* — Mark M. Friedman

(57) ABSTRACT

The present disclosure provides a display panel and a display device. The display panel includes a normal display region and a special-shaped display region. A plurality of second pixel groups and second scan lines are sequentially disposed in the special-shaped display region. Each of the plurality of second pixel groups includes a plurality of rows of sub-pixels disposed along a first direction. The sub-pixels in each row are connected to the second scan lines in a corresponding row. The first scan lines are connected to the second scan lines to reduce a size of sub-pixels in each of the plurality of second pixel groups, increase a pixel density, and increase a display quality.

16 Claims, 2 Drawing Sheets

DISPLAY PANEL AND DISPLAY DEVICE

FIELD OF DISCLOSURE

The present disclosure is related to the field of display technology, and specifically, to a display panel and a display device.

BACKGROUND OF DISCLOSURE

With rapid development of display technology, breakthrough progresses have been made in types of display panels and their functions.

The display panels include special-shaped display panels and non-special-shaped display panels. The special-shaped display panels are transformed from traditional display panels. Through this improvement, the display panels can better adapt to their usage scenario and improve display effects thereof. However, for the special-shaped display panels in the prior art, because their shapes and structures are changed, their display regions or non-display regions are no longer regular shapes such as traditional rectangles. When a display region of a special-shaped display panel displays images, in a region close to a special-shaped boundary of the special-shaped display panel, pixel units cannot completely coincide or match the special-shaped boundary of the special-shaped display panel. As a result, when the display region of the special-shaped display panel close to the special-shaped boundary displays images, problems of zigzag patterns, unsmooth edges of images at boundaries, and severe color cast easily occur.

In summary, in the special-shaped display panel in the prior art, in the region close to the special-shaped boundary of the special-shaped display panel, the pixel units cannot completely coincide or match the special-shaped boundary of the special-shaped display panel. When it displays images, problems of zigzag patterns, unsmooth edges of images at boundaries, and severe color cast easily occur.

SUMMARY OF DISCLOSURE

The present disclosure provides a display panel and a display device to solve problems of zigzag patterns, unsmooth edges of images at boundaries, and severe color cast, which occur at a special-shaped boundary of a special-shaped display panel in the prior art.

In order to solve the above technical problem, embodiments of the present disclosure provide technical solutions as follows.

According to a first aspect of an embodiment of the disclosure, a display panel is provided.

A display region of the display panel includes a normal display region and a special-shaped display region adjacent to the normal display region.

A plurality of first pixel groups and first scan lines connected to the plurality of first pixel groups are sequentially disposed in the normal display region. A plurality of second pixel groups and second scan lines connected to the plurality of second pixel groups are sequentially disposed in the special-shaped display region.

Each of the plurality of second pixel groups includes a plurality of rows of sub-pixels disposed along a first direction. The sub-pixels in each row are connected to the second scan lines in a corresponding row. The first scan lines in each row are respectively connected to the second scan lines in each of the plurality of second pixel groups in a corresponding row.

According to an embodiment of the present disclosure, in the first direction, a number of the second scan lines in each of the plurality of second pixel groups is greater than or equal to two.

According to an embodiment of the present disclosure, each of the plurality of second pixel groups includes a first sub-pixel and a second sub-pixel. The first sub-pixel is adjacent to the second sub-pixel.

According to an embodiment of the present disclosure, the number of the second scan lines in each of the plurality of second pixel groups is two. The first sub-pixel in each row is connected to the second scan lines in a corresponding row. The second sub-pixel in each row is connected to the second scan lines in a corresponding row.

According to an embodiment of the present disclosure, a pixel area of the first sub-pixel is equal to a pixel area of the second sub-pixel.

According to an embodiment of the present disclosure, a pixel area of each of the plurality of first pixel groups is equal to a pixel area of each of the plurality of second pixel groups.

According to an embodiment of the present disclosure, a pixel area of each of the sub-pixels in each of the plurality of first pixel groups is greater than a pixel area of each of the sub-pixels in each of the plurality of second pixel groups.

According to an embodiment of the present disclosure, a pixel area of each of the plurality of first pixel groups is greater than a pixel area of each of the plurality of second pixel groups.

According to an embodiment of the present disclosure, the display panel further includes data lines disposed along a second direction. The second direction is perpendicular to the first direction. Each of the data lines is respectively connected to the plurality of first pixel groups and the plurality of second pixel groups in the second direction.

According to an embodiment of the present disclosure, the special-shaped display region of the display panel includes a special-shaped boundary. A shape of the special-shaped boundary includes a circular arc. The plurality of second pixel groups are disposed within the circular arc.

According to a second aspect of an embodiment of the disclosure, a display device is further provided. The display device includes a display panel.

A display region of the display panel includes a normal display region and a special-shaped display region adjacent to the normal display region.

A plurality of first pixel groups and first scan lines connected to the plurality of first pixel groups are sequentially disposed in the normal display region. A plurality of second pixel groups and second scan lines connected to the plurality of second pixel groups are sequentially disposed in the special-shaped display region.

Each of the plurality of second pixel groups includes a plurality of rows of sub-pixels disposed along a first direction. The sub-pixels in each row are connected to the second scan lines in a corresponding row. The first scan lines in each row are respectively connected to the second scan lines in each of the plurality of second pixel groups in a corresponding row.

According to an embodiment of the present disclosure, in the first direction, a number of the second scan lines in each of the plurality of second pixel groups is greater than or equal to two.

According to an embodiment of the present disclosure, each of the plurality of second pixel groups includes a first sub-pixel and a second sub-pixel. The first sub-pixel is adjacent to the second sub-pixel.

According to an embodiment of the present disclosure, the number of the second scan lines in each of the plurality of second pixel groups is two. The first sub-pixel in each row is connected to the second scan lines in a corresponding row. The second sub-pixel in each row is connected to the second scan lines in a corresponding row.

According to an embodiment of the present disclosure, a pixel area of the first sub-pixel is equal to a pixel area of the second sub-pixel.

According to an embodiment of the present disclosure, a pixel area of each of the plurality of first pixel groups is equal to a pixel area of each of the plurality of second pixel groups.

According to an embodiment of the present disclosure, a pixel area of each of the sub-pixels in each of the plurality of first pixel groups is greater than a pixel area of each of the sub-pixels in each of the plurality of second pixel groups.

According to an embodiment of the present disclosure, a pixel area of each of the plurality of first pixel groups is greater than a pixel area of each of the plurality of second pixel groups.

According to an embodiment of the present disclosure, the display panel further includes data lines disposed along a second direction. The second direction is perpendicular to the first direction. Each of the data lines is respectively connected to the plurality of first pixel groups and the plurality of second pixel groups in the second direction.

According to an embodiment of the present disclosure, the special-shaped display region of the display panel includes a special-shaped boundary. A shape of the special-shaped boundary includes a circular arc. The plurality of second pixel groups are disposed within the circular arc.

The embodiments of the present disclosure provide the display panel and display device to improve a pixel structure in the special-shaped display region of the display panel. A single sub-pixel in an original pixel group is changed into multiple sub-pixels without changing a pixel area of each of the pixel groups. The pixel area of each of the sub-pixels is reduced, which increases the number of the sub-pixels in a unit area and a density of the sub-pixels in the special-shaped display region. When the special-shaped display region displays images, at the special-shaped boundary, the problem of the zigzag patterns is effectively reduced, and display effects are increased.

DESCRIPTION OF DRAWINGS

In order to describe embodiments and technical solutions in the prior art clearly, drawings to be used in the description of the embodiments or the prior art will be described briefly below. Obviously, drawings described below are only for some embodiments of the present disclosure, and other drawings may be obtained by those skilled in the art based on these drawings without creative efforts.

DETAILED DESCRIPTION OF PREFERRED EMBODIMENTS

To further explain the technical means and effect of the present disclosure, the following refers to embodiments and drawings for detailed description. Obviously, the described embodiments are only for some embodiments of the present disclosure, instead of all embodiments. Based on the embodiments of the present disclosure, all other embodiments obtained by those skilled in the art without creative work fall into a protection scope of the present disclosure.

Figure 1:
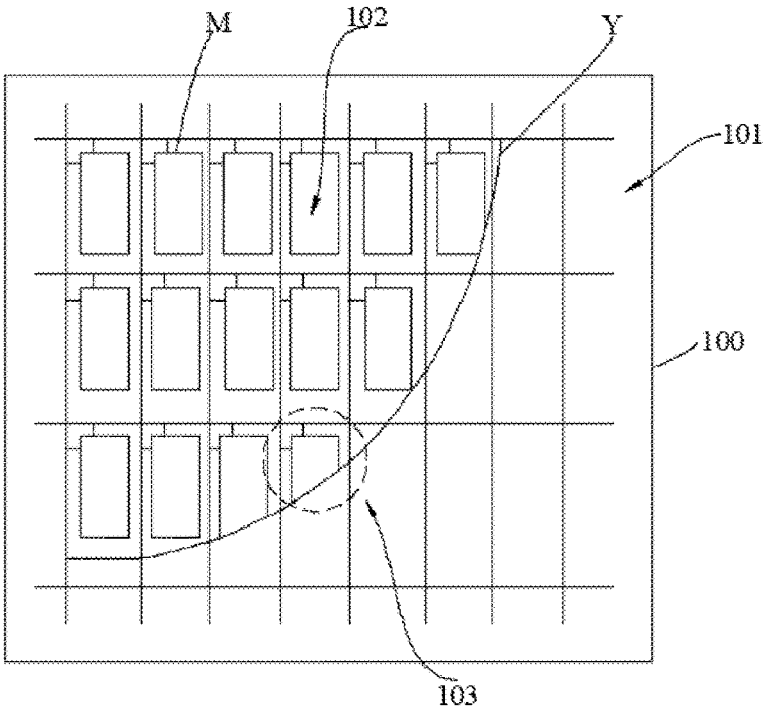
FIG. 1 is a schematic diagram of a partial view of a pixel structure of a special-shaped display panel in the prior art.

As shown in FIG. 1, which is a schematic diagram of a partial view of a pixel structure of a special-shaped display panel in the prior art, for the special-shaped display panel 100, its display region 101 is no longer a regular display shape such as a rectangle but is a display region with an irregular shape.

Near a boundary line Y of the special-shaped display region 102, as shown in a region 103, because a shape of the display region 101 is changed, a shape of a pixel unit M near the boundary line Y is changed accordingly. When it displays images, pixels near the boundary line Y cannot completely display images because some of them are removed, resulting in a zigzag image, severe color cast, and bad display effects.

Figure 2:
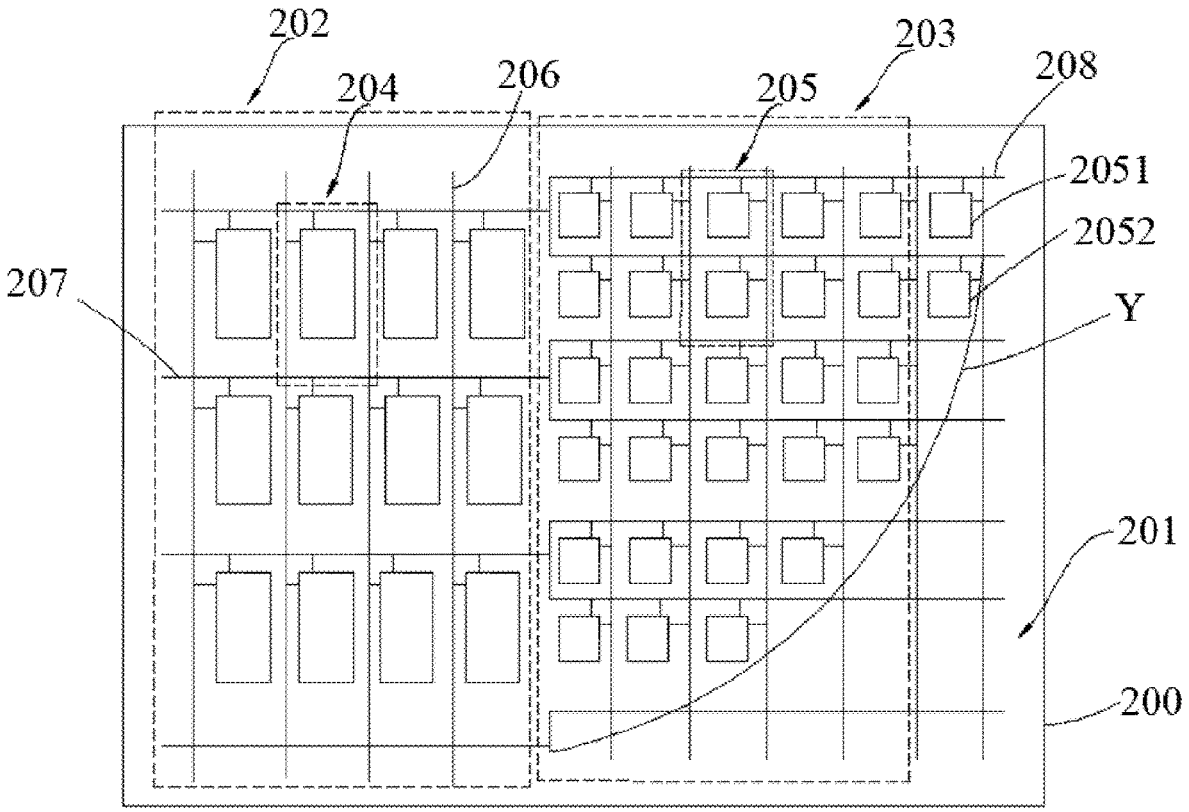
FIG. 2 is a schematic diagram of a partial view of a pixel structure of a display panel provided by an embodiment of the present disclosure.

As shown in FIG. 2, which is a schematic diagram of a partial view of a pixel structure of a display panel provided by an embodiment of the present disclosure, in an embodiment of the present disclosure, the display panel 200 includes a display region 201. Meanwhile, the display region 201 further includes a normal display region 202 and a special-shaped display region 203. The normal display region 202 and the special-shaped display region 203 are adjacent to constitute the entire display region 201 of the display panel 200.

Furthermore, the display panel 200 further includes data lines 206 and first scan lines 207, which are disposed in an array. The data lines 206 are disposed along a second direction, which is a direction of rows in FIG. 2 in this embodiment of the present disclosure. The first scan lines 207 are disposed along a first direction, which is a direction of columns in FIG. 2 in this embodiment of the present disclosure. This can provide data signals and scan signals to pixels in the display region.

Specifically, in an embodiment of the present disclosure, a plurality of first pixel groups 204 are disposed in an array in the normal display region 202. The plurality of first pixel groups 204 are regularly arranged in a row direction and a column direction. A structure of the normal display region 202 is a normal display region. Therefore, a shape of each of the plurality of first pixel groups 204 is not changed, which is disposed as a conventional pixel structure during design. In each row, the plurality of first pixel groups 204 in each row are respectively connected to their corresponding first scan lines 207. Meanwhile, each of the plurality of first pixel groups 204 is further connected to a corresponding data line 206. Accordingly, the plurality of first pixel groups 204 are formed in an array in the normal display region 202.

In the special-shaped display region 203, a shape of the special-shaped display region 203 can be an irregular shape. In an embodiment of the present disclosure, the special-shaped display region 203 includes a special-shaped boundary Y. Specifically, as shown in FIG. 2, the special-shaped boundary Y being a circular arc is taken as an example.

A plurality of second pixel groups 205 are sequentially disposed in the special-shaped display region 203. The plurality of second pixel groups 205 are disposed along the first direction and the second direction, which are disposed along the row direction and the column direction of the display panel 200.

Furthermore, in a same row of the special-shaped display region 203 corresponding to each row of the normal display region 202, each of the plurality of second pixel groups 205 includes a plurality of rows of sub-pixels. In an embodiment of the present disclosure, each of the plurality of second pixel groups 205 including two rows of the sub-pixels is taken as an example. This embodiment of the present disclosure is only an example, and each of the plurality of second pixel groups 205 can further includes three or more rows of the sub-pixels.

Specifically, each of the plurality of second pixel groups 205 includes a first sub-pixel 2051 and a second sub-pixel 2052. The first sub-pixel 2051 and the second sub-pixel 2052 are up and down adjacent and are disposed in each of the plurality of second pixel groups 205. Correspondingly, in each row of the first sub-pixel 2051 and each row of the second sub-pixel 2052, second scan lines 208 are correspondingly disposed. In each of the plurality of second pixel groups 205, as rows of the sub-pixels are disposed, the second scan lines 208 corresponding to the rows of sub-pixel are disposed correspondingly. When there are two rows of the sub-pixels in each of plurality of second pixel groups 205, a number of the second scan lines 208 is two. When there are N rows of the sub-pixels in each of plurality of second pixel groups 205, correspondingly, the number of the second scan lines 208 are N as well, and N is greater than or equal to two. In this way, the second scan lines 208 are respectively connected to all rows of the sub-pixels to provide scan signals for ensuring the display panel displays images properly.

In an embodiment of the present disclosure, in the normal display region 202, for any rows of the plurality of first pixel groups 204, each of the plurality of first pixel groups 204 is connected to one data line 206 and one first scan line 207, which means that only one first scan line 207 is used in a same row. However, in the special-shaped display region 203, the special-shaped boundary Y is deformed the most, so each of the plurality of second pixel groups 205 is configured with the plurality of rows of the sub-pixels when a pixel structure of the special-shaped display region 203 is designed. Large-sized pixels in each pixel group are divided into multiple small-sized sub-pixels, so a pixel density in a unit area is increased. Because the pixel density in the unit area of the special-shaped display region 203 is increased, display effects at the special-shaped boundary is ensured, and a display quality of the display panel is increased.

Figure 3:
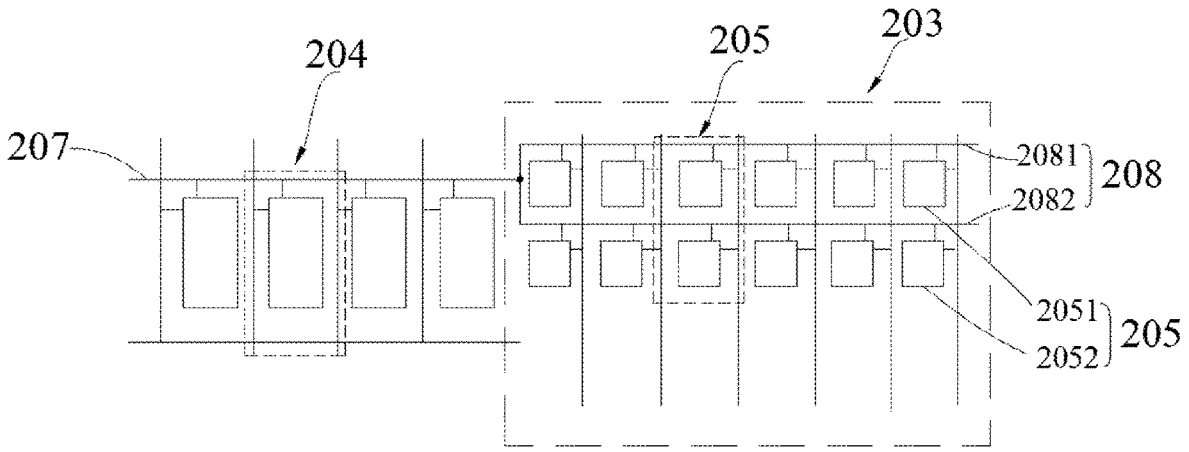
FIG. 3 is a schematic diagram of a pixel structure in any row provided by an embodiment of the present disclosure.

Furthermore, as shown in FIG. 3, which is a schematic diagram of a pixel structure in any row provided by an embodiment of the present disclosure, with reference with the pixel structure in FIG. 2, in the special-shaped display region 203, there are two rows of sub-pixels disposed in each of the plurality of second pixel groups 205, which are the first sub-pixel 2051 and the second sub-pixel 2052. First sub-pixels 2051 in a same row are connected to the third scan line 2081. Second sub-pixels 2052 in a same row are connected to the fourth scan line 2082. The third scan line 2081 and the fourth scan line 2082 are both the second scan lines 208. Meanwhile, in the normal display region, the first scan lines 207 and the second scan lines 208 in a same row in the normal display region are connected, which means that the first scan lines 207 are divided into two in the special-shaped display region 203. Therefore, a number of sub-pixels in each of the plurality of second pixel groups 205 is increased.

In an embodiment of the present disclosure, a pixel area of each of the plurality of first pixel groups 204 is equal to a pixel area of each of the plurality of second pixel groups 205. Also, in each of the plurality of second pixel groups 205, a pixel area of the first sub-pixel 2051 is equal to a pixel area of the second sub-pixel 2052. Because a shape and a structure of the normal display region are not changed, each of the plurality of first pixel groups can be disposed with one sub-pixel during design, or it can be disposed with multiple sub-pixels to let a pixel area of each of the sub-pixels in each of the plurality of first pixel groups 204 greater than a pixel area of each of the sub-pixels in each of the plurality of second pixel groups 205. Therefore, a pixel density of the special-shaped display region 203 is increased to ensure the display quality.

In an embodiment of the present disclosure, a pixel area of each of the plurality of first pixel groups 204 is greater than a pixel area of each of the plurality of second pixel groups 205.

Figure 4:
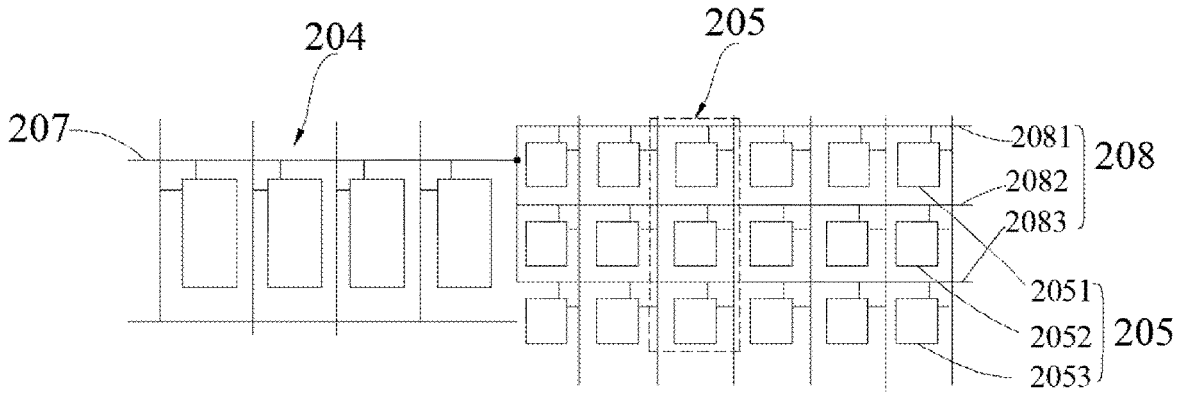
FIG. 4 is another schematic diagram of the pixel structure provided by an embodiment of the present disclosure.

Furthermore, as shown in FIG. 4, which is another schematic diagram of the pixel structure provided by an embodiment of the present disclosure, in order to increase the pixel density of the special-shaped display region, a pixel size of sub-pixels in each of the plurality of second pixel groups 205 is further reduced. In this embodiment of the present disclosure, three rows of the sub-pixels are disposed along the first direction in each of the plurality of second pixel groups 205, which are a first sub-pixel 2051, a second sub-pixel 2052, and a third sub-pixel 2053. Correspondingly, each of the plurality of second pixel groups 205 can be disposed with three second scan lines 208, which are a scan line 2081, a scan line 2082, and a scan line 2083. Each row of the scan line is connected to the sub-pixel in a corresponding row. Meanwhile, one first scan line 207 in the normal display region is connected the above three second scan lines 208 to provide scan signals. In this way, the pixel size of sub-pixels in each of the plurality of second pixel groups 205 is further reduced. The pixel density of the special-shaped display region is increased, so as to improve the problem of zigzag patterns at the special-shaped boundary, improve the color cast, and increase the display quality.

The present disclosure further provides a display device. the display device includes a display panel. The display panel is designed according to a pixel structure of an embodiment of the present disclosure, which reduces a size of pixels in a special-shaped display region to increase a density of pixels in the special-shaped display region, and display effects of the display panel in the special-shaped display region of the display device. A display region of the display panel includes a normal display region and a special-shaped display region adjacent to the normal display region. A plurality of first pixel groups and first scan lines connected to the plurality of first pixel groups are sequentially disposed in the normal display region. A plurality of second pixel groups and second scan lines connected to the plurality of second pixel groups are sequentially disposed in the special-shaped display region. Each of the plurality of second pixel groups includes a plurality of rows of sub-pixels disposed along a first direction. The sub-pixels in each row are connected to the second scan lines in a corresponding row. The first scan lines in each row are respectively connected to the second scan lines in each of the plurality of second pixel groups in a corresponding row.

In the display device of an embodiment of the present disclosure, in the first direction, a number of the second scan lines in each of the plurality of second pixel groups is greater than or equal to two.

In the display device of an embodiment of the present disclosure, each of the plurality of second pixel groups includes a first sub-pixel and a second sub-pixel. The first sub-pixel is adjacent to the second sub-pixel.

In the display device of an embodiment of the present disclosure, the number of the second scan lines in each of the plurality of second pixel groups is two. The first sub-pixel in each row is connected to the second scan lines in a corresponding row. The second sub-pixel in each row is connected to the second scan lines in a corresponding row.

In the display device of an embodiment of the present disclosure, a pixel area of the first sub-pixel is equal to a pixel area of the second sub-pixel.

In the display device of an embodiment of the present disclosure, a pixel area of each of the plurality of first pixel groups is equal to a pixel area of each of the plurality of second pixel groups.

In the display device of an embodiment of the present disclosure, a pixel area of each of the sub-pixels in each of the plurality of first pixel groups is greater than a pixel area of each of the sub-pixels in each of the plurality of second pixel groups.

In the display device of an embodiment of the present disclosure, a pixel area of each of the plurality of first pixel groups is greater than a pixel area of each of the plurality of second pixel groups.

In the display device of an embodiment of the present disclosure, the display panel further includes data lines disposed along a second direction. The second direction is perpendicular to the first direction. Each of the data lines is respectively connected to the plurality of first pixel groups and the plurality of second pixel groups in the second direction.

In the display device of an embodiment of the present disclosure, the special-shaped display region of the display panel includes a special-shaped boundary. A shape of the special-shaped boundary includes a circular arc. The plurality of second pixel groups are disposed within the circular arc.

The display panel and the display device provided by embodiments of the present disclosure are described in detail above, and the description of embodiments above is only for helping to understand technical solutions of the present disclosure and its core idea. Understandably, for a person of ordinary skill in the art can make various modifications of the technical solutions of the embodiments of the present disclosure above. However, it does not depart from the scope of the technical solutions of the embodiments of the present disclosure.

What is claimed is:

1. A display panel, wherein a display region of the display panel comprises a normal display region and a special-shaped display region, located at a special-shaped boundary, adjacent to the normal display region;

a plurality of first pixel groups disposed in the normal display region, wherein each first sub-pixel group represents a plurality of sub-pixels located in a same row;

a plurality of first scan lines corresponding to each row, wherein each pixel in the first pixel group is connected to one of the same first scan lines;

and a plurality of second pixel groups disposed in the special-shaped display region, wherein each second pixel group represents a plurality of sub-pixels located in a row;

a plurality of second scan lines, wherein each sub-pixel in a second pixel group is connected to one of the same second scan lines;

an N, where N is equal to or greater than two, number of adjacent second scan lines are connected to each other;

and wherein the N number of adjacent second scan lines are connected to a corresponding row of one of the first scan lines in a first direction.

2. The display panel according to claim 1, wherein each of the plurality of second pixel groups comprises a first sub-pixel and a second sub-pixel, and the first sub-pixel is adjacent to the second sub-pixel.

3. The display panel according to claim 2, wherein a pixel area of the first sub-pixel is equal to a pixel area of the second sub-pixel.

4. The display panel according to claim 1, wherein a pixel area of each of the plurality of first pixel groups is equal to a pixel area of each of the plurality of second pixel groups.

5. The display panel according to claim 4, wherein a pixel area of each of the sub-pixels in each of the plurality of first pixel groups is greater than a pixel area of each of the sub-pixels in each of the plurality of second pixel groups.

6. The display panel according to claim 1, wherein a pixel area of each of the plurality of first pixel groups is greater than a pixel area of each of the plurality of second pixel groups.

7. The display panel according to claim 1, further comprising data lines disposed along a second direction, wherein the second direction is perpendicular to the first direction, and each of the data lines is respectively connected to the plurality of first pixel groups and the plurality of second pixel groups in the second direction.

8. The display panel according to claim 1, wherein the special-shaped display region of the display panel comprises a special-shaped boundary, a shape of the special-shaped boundary comprises a circular arc, and the plurality of second pixel groups are disposed within the circular arc.

9. A display device, comprising a display panel, wherein a display region of the display panel comprises a normal display region and a special-shaped display region, located at a special-shaped boundary, adjacent to the normal display region;

a plurality of first pixel groups disposed in the normal display region, wherein each first sub-pixel group represents a plurality of sub-pixels located in a same row;

a plurality of first scan lines corresponding to each row, wherein each pixel in the first pixel group is connected to one of the same first scan lines;

and a plurality of second pixel groups disposed in the special-shaped display region, wherein each second pixel group represents a plurality of sub-pixels located in a row;

a plurality of second scan lines, wherein each sub-pixel in a second pixel group is connected to one of the same second scan lines;

an N, where N is equal to or greater than two, number of adjacent second scan lines are connected to each other;

and wherein the N number of adjacent second scan lines are connected to a corresponding row of one of the first scan lines in a first direction.

10. The display device according to claim 9, wherein each of the plurality of second pixel groups comprises a first sub-pixel and a second sub-pixel, and the first sub-pixel is adjacent to the second sub-pixel.

11. The display device according to claim 10, wherein a pixel area of the first sub-pixel is equal to a pixel area of the second sub-pixel.

12. The display device according to claim 9, wherein a pixel area of each of the plurality of first pixel groups is equal to a pixel area of each of the plurality of second pixel groups.

13. The display device according to claim 12, wherein a pixel area of each of the sub-pixels in each of the plurality of first pixel groups is greater than a pixel area of each of the sub-pixels in each of the plurality of second pixel groups.

14. The display device according to claim 9, wherein a pixel area of each of the plurality of first pixel groups is greater than a pixel area of each of the plurality of second pixel groups.

15. The display device according to claim 9, further comprising data lines disposed along a second direction, wherein the second direction is perpendicular to the first direction, and each of the data lines is respectively connected to the plurality of first pixel groups and the plurality of second pixel groups in the second direction.

16. The display device according to claim 9, wherein the special-shaped display region of the display panel comprises a special-shaped boundary, a shape of the special-shaped boundary comprises a circular arc, and the plurality of second pixel groups are disposed within the circular arc.

* * * * *